United States Patent [19]

Laird

[11] Patent Number: 4,492,409

[45] **Date of Patent: * Jan. 8, 1985**

[54] FURNITURE WITH REMOVABLE PADDED CUSHIONS

[76] Inventor: William B. Laird, 121 First Ave, Red Lion, Pa. 17356

[ * ] Notice: The portion of the term of this patent subsequent to Jul. 26, 2000 has been disclaimed.

[21] Appl. No.: 435,436

[22] Filed: Oct. 20, 1982

Related U.S. Application Data

[63] Continuation-in-part of Ser. No. 237,338, Feb. 23, 1981, Pat. No. 4,395,071.

[51] Int. Cl.[3] ..... A47C 4/02

[52] U.S. Cl. ..... 297/440; 297/443; 5/411

[58] Field of Search ..... 297/440, 232, 443, 444, 297/DIG. 1; 292/7; 5/411, 9 R; 70/116, 120, 403

[56] References Cited

U.S. PATENT DOCUMENTS

| | | | |
|---|---|---|---|
| 1,631,081 | 5/1927 | Bennett | 5/411 X |
| 2,673,353 | 3/1954 | Dean et al. | 5/9 R |
| 2,783,717 | 3/1957 | Meldrum | 5/9 R X |
| 3,972,565 | 8/1976 | Smith | 297/455 |
| 3,989,300 | 11/1976 | Heumann | 297/440 |
| 4,138,949 | 2/1979 | Gutridge et al. | 5/9 R X |
| 4,285,544 | 8/1981 | Zapf | 297/440 |

FOREIGN PATENT DOCUMENTS

| | | | |
|---|---|---|---|
| 178298 | 4/1954 | Austria | 292/7 |
| 1283660 | 12/1962 | France | 297/442 |
| 1279416 | 6/1972 | United Kingdom | 297/444 |

*Primary Examiner*—William E. Lyddane
*Assistant Examiner*—Peter R. Brown
*Attorney, Agent, or Firm*—Panitch. Schwarze, Jacobs & Nadel

[57] ABSTRACT

Furniture in the form of a chair, loveseat or couch is provided with a frame having at least one removable cushion. The cushion has oppositely disposed grooves. Each groove is adapted to receive a tongue on a frame of the furniture. A latch mechanism is provided within the cushion for cooperating with mating structure on an associated tongue whereby the cushion may be removed and replaced by another similar cushion or may merely be turned over and reinstalled in the furniture.

10 Claims, 5 Drawing Figures

20
52b
52
50
44
4
42
40
59
52a
55
58
62
56
64
26
22
60
54
36'
32'
14
38'
4

FURNITURE WITH REMOVABLE PADDED CUSHIONS

COPENDING APPLICATION

This application is a continuation-in-part of application Ser. No. 237,338 filed on Feb. 2, 1981 now U.S. Pat. No. 4,395,071 issued on July 26, 1983, and entitled "Furniture With Removable Cushions".

BACKGROUND

A conventional chair has a seat cushion and a back cushion. A loveseat has two seat cushions and two back cushions. A couch has three seat cushions and three back cushions. There is a need for furniture of that type wherein the cushions are adapted to be removed, turned over and replaced while being latched to the furniture frame in a manner so that only authorized persons may remove the cushions. The present invention is directed to a solution of that need.

SUMMARY OF THE INVENTION

The present invention is directed to furniture of the chair, loveseat and couch type. The furniture includes a frame having at least one removable cushion. The cushion has oppositely disposed grooves. A pair of tongues is provided on the frame. Each tongue projects into one of the grooves. A latch means is provided within the cushion. The latch means includes a latch member projecting into each one of the grooves in the cushion for latching cooperation with mating structure on the associated tongue. An actuator is provided on the cushion and connected to the latch members for releasing the latch members so that the cushion may be removed. The latch means includes a plate having a non-circular keyhole attached to the cushion. The actuator of said latch means is aligned with said keyhole for reception of a key and is generally perpendicular to said latch member.

The present invention also includes as an article of manufacture a furniture cushion per se. The cushion includes a padded framework having an outer covering. Exposed grooves are provided on opposite sides of the framework. A latch means is supported within the cushion. The latch means includes a latch member partially exposed in each groove for latching the cushion to a frame and also includes an actuator aligned with the keyhole in a plate on the cushion for reception of a key.

It is an object of the present invention to provide furniture having cushions which are removable and/or replaceable by way of a key in the possession of authorized personnel.

It is another object of the present invention to provide furniture with removable cushions by way of a concealed latch means requiring a special tool to facilitate unlatching of the cushions from a frame.

It is another object of the present invention to provide a novel article of manufacture in the form of a removable, replaceable furniture cushion.

Other objects and advantages will appear hereinafter.

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
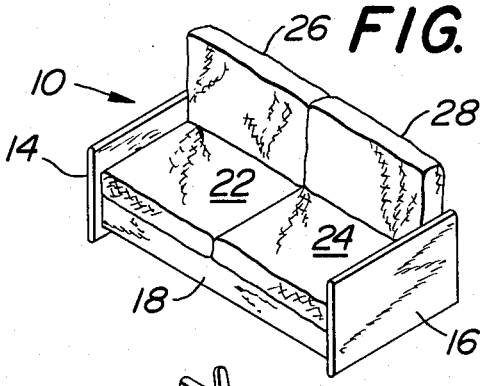
FIG. 1 is a perspective view of furniture in accordance with the present invention.

Referring to the drawings in detail, wherein like numerals indicate like elements, there is shown in FIG. 1 one form of furniture in accordance with the present invention. The furniture 10 is in the form of a loveseat having a frame designated generally as 12. The frame 12 includes ends 14 and 16 which are vertically disposed and coupled together by horizontally disposed front member 18 and rear member 20. The furniture 10 includes two seat cushions 22, 24 and two back cushions 26, 28.

Figure 2:
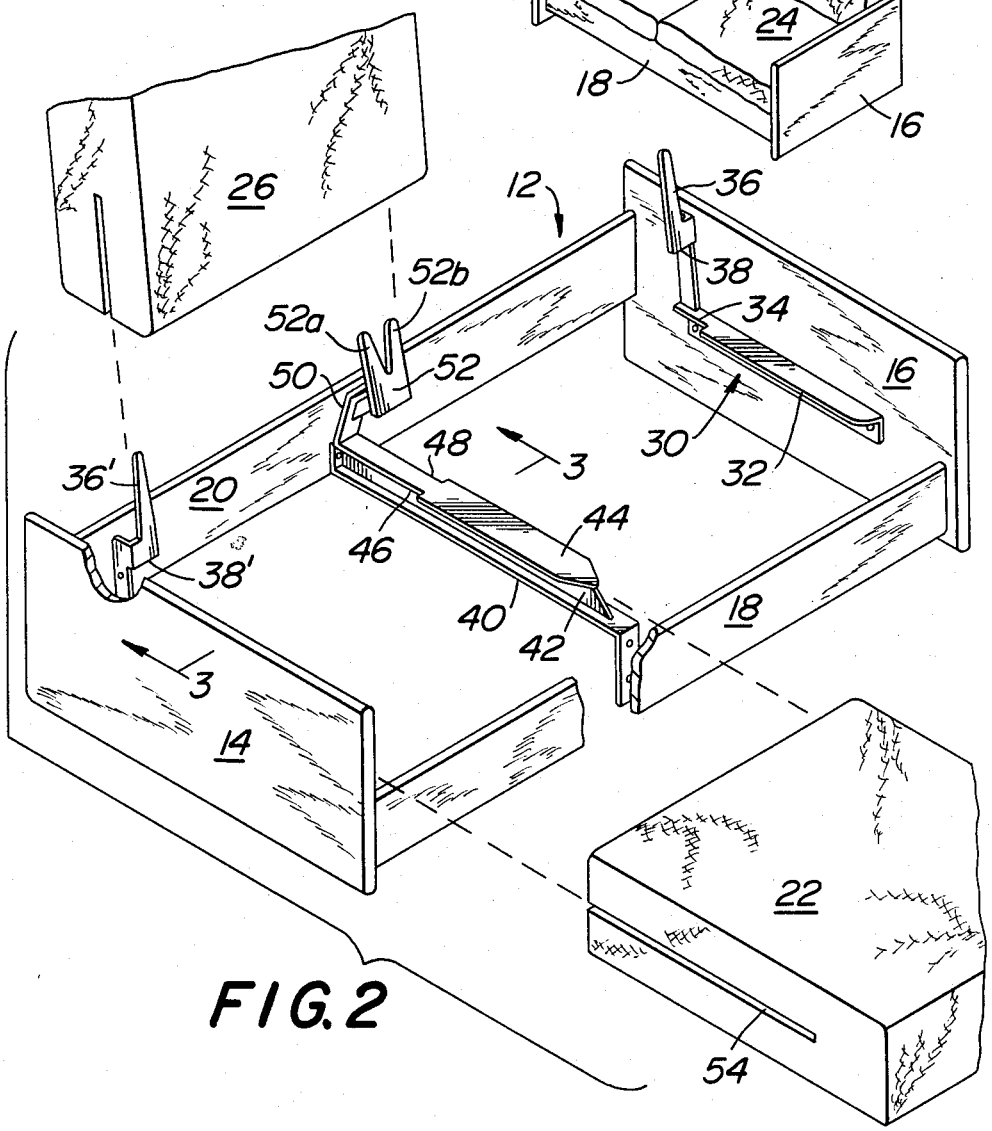
FIG. 2 is an exploded view of the furniture shown in FIG. 1.

A rail 30 is bolted to the inner surface of the frame end 16 as shown more clearly in FIG. 2. Rail 30 includes a generally horizontally disposed tongue 32 having a rounded nose portion at the end adjacent the front member 18. Tongue 32 preferably is tilted so that its rear end is lower than its front end. At the other end, the tongue 32 is provided with a notch 34. Rail 30 includes a slightly inclined, generally vertical tongue 36 having a shoulder 38 at the lower end thereof. The frame end 14 is provided with an identical rail corresponding to rail 30 and the components thereof are identified by corresponding primed numerals.

A brace 40 extends between the front and rear members 18, 20 at approximately the center thereof. The brace 40 has an upstanding rib 42 which supports a generally horizontally disposed tongue 44. Tongue 44 preferably is tilted so that its rear end is lower than its front end. Tongue 44 has a pointed end adjacent the front member 18 and a pair of notches 46, 48 on opposite sides thereof at its other end. An upstanding leg 50 is connected to the tongue 44 and supports a bifurcated tongue 52. Tongue 52 lies in the same plane as the tongues 36, 36'. A shoulder is defined by the bottom surface of tongue 52.

Seat cushion 22 is provided with a pair of slots 54, 55 on opposite sides thereof. One of the slots on the cushion 22 receives the tongue 32' while the other slot receives a portion of the tongue 44. See FIG. 3. Cushion 24 is similarly constructed and the slots thereof cooperate with the other half of tongue 44 and with the tongue 32. Cushions 26 and 28 are similarly provided with slots although shorter than the slots on the seat cushions. The bottom surface of cushions 26, 28 extends for the full width of the cushions. Cushions 26, 28 are shorter than cushions 22, 24. The slots on cushions 26 cooperate with the tongue 36' and one half 52*a* of the tongue 52. The slots on cushion 28 cooperate with the other half 52*b* of the tongue 52 and with the tongue 36. The cushions are otherwise identical and only cushion 22 will be described in detail.

Figure 3:
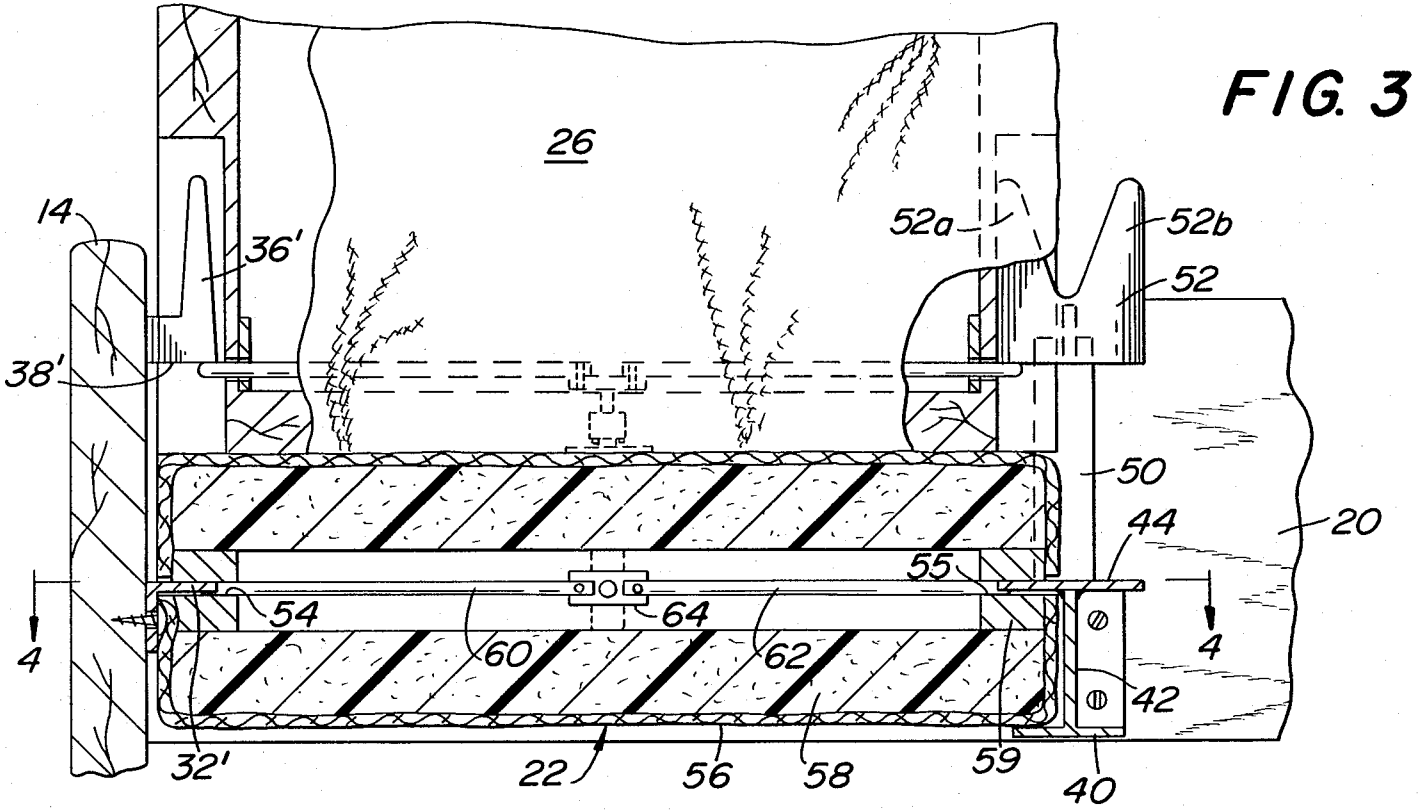
FIG. 3 is a sectional view taKen along the line 3—3 in FIG. 2 but on an enlarged scale.
Figure 4:
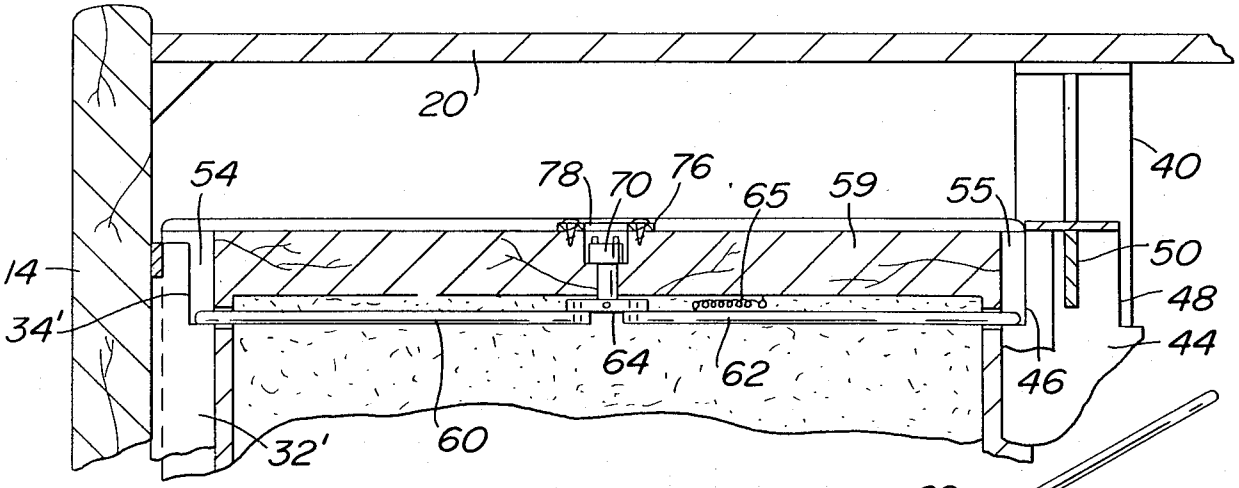
FIG. 4 is a sectional view taken along the line 4—4 in FIG. 3.
Figure 5:
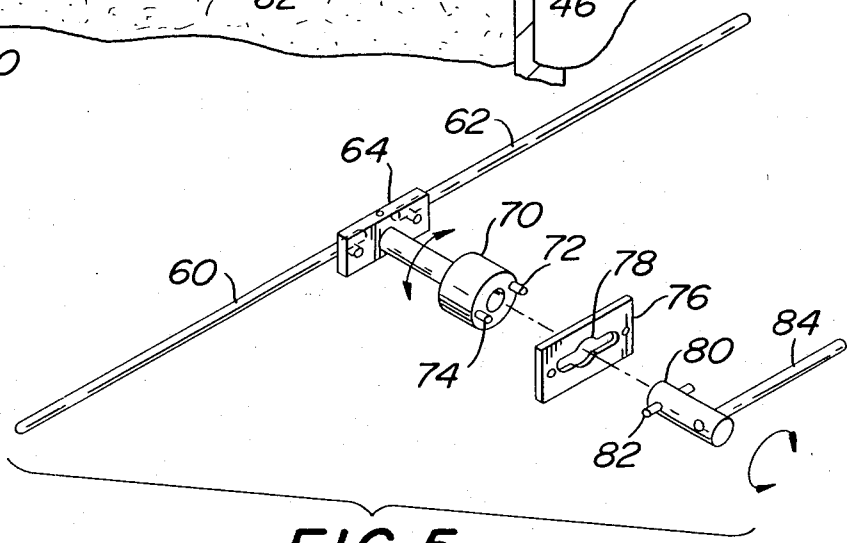
FIG. 5 is a perspective view of a latch means and its associated key.

As shown more clearly in FIGS. 3 and 4, the cushion 22 has a rectangular frame 59 between layers of padding 58. The cushion is covered with fabric 56. The slots 54, 55 are provided in parallel portions of the frame 59 along the sides thereof generally equidistant from the top and bottom surfaces of the cushion 22.

A latch mechanism is provided within each of the cushions between the layers of padding 58. The latch means includes a pair of rods 60, 62 each pivoted at one end to a rectangular link member 64. Rod 60 has its free end extending through an elliptical hole in one leg of the rectangular frame 59. Similarly, the free end of rod 62 extends through an ellipitical hole in one leg of the opposite side of the frame 59. The holes in the frame 59 align the free ends of the rods 60, 62 with the grooves 54, 55 on opposite sides of the cushion 22. Spring 65 is attached at one end to frame 59 and at its other end to rod 62. Spring 65 biases rods 60, 62 to the position shown in FIG. 4.

A latch 70 is integral with the link member 64 and is generally perpendicular to the rods 60, 62. The latch 70 has a pair of axially extending spaced projections 72, 74. Latch 70 extends through a hole in the frame 59 at the read end of the cushion 22 as shown more clearly in FIG. 4 and is visible through a keyhole 78 on the plate 76 attached to the frame 59. The keyhole 78 is non-circular. A key 80 has a pair of projections 82 extending therefrom adjacent one end thereof and a handle 84 connected to the other end. The key 80 and projections 82 correspond to the shape of the keyhole 78. Each of the projections 82 is adapted to engage one of the projections 72, 74 to facilitate pivoting the latch 70 about its longitudinal axis to thereby extend or withdraw the rods 60, 62 relative to their associated grooves 54, 55.

As shown more clearly in FIG. 4, the ends of the rods 60, 62 extend to the notches 34', 46 respectively. In order to remove the cushion 22, it is necessary to insert the key 80 through the keyhole 78 and pivot the latch 70 to withdraw the rods 60, 62. Thereafter, the seat cushion may be removed for replacement or may merely be turned over to expose the other side of the fabric 56. Seat cushion 24 similarly cooperates with the notches 34 and 48. The back cushion 26 has similar rods which cooperate with the shoulder 38' and the shoulder defined by the bottom surface of the tongue 52. The lower end of seat cushion 26 overlies the innermost end portion of seat cushion 22 which obscures the keyhole for the cushion 26. Cushions 24 and 28 are similarly interrelated. The frame 59 acts as a bearing for pivotable movement of the latch 70.

Thus, it will be seen that the furniture of the present invention utilizes a minimum number of components while providing cushions which are removable and/or replaceable by way of a tool such as key 80 to be in the possession of authorized personnel.

The present invention may be embodied in other specific forms without departing from the spirit or essential attributes thereof and, accordingly, reference should be made to the appended claims, rather than to the foregoing specification, as indicating the scope of the invention.

I claim:

1. Furniture of the chair, loveseat and couch type comprising a frame having at least one removable cushion, said cushion having oppositely disposed grooves, a pair of tongues on said frame, each tongue projecting into one of said grooves, latch means within said cushion, said latch means including a latch member projecting into at least one of the grooves on the cushion for latching cooperation with mating structure on the associated tongue, an actuator on the cushion connected to the latch member for releasing the latch member so that the cushion may be removed, a plate having a non-circular keyhole attached to said cushion, said actuator being aligned with said keyhole for reception of a key and being generally perpendicular to said latch member at a rear end of said cushion.

2. Furniture in accordance with claim 1 wherein said actuator has a pair of axially extending projections on an end face thereof adjacent said keyhole to facilitate pivoting the actuator about its longitudinal axis upon contact with a mating key.

3. Furniture in accordance with claim 1 wherein at least one of said tongues is attached to the inner surface of a vertically disposed end of said frame.

4. Furniture in accordance with claim 1 wherein said cushion is a seat cushion, a back cushion supported by said frame, said back cushion being in overlying relationship with the innermost end of the seat cushion so that an actuator associated with the latch means in the back cushion is obscured by said seat cushion.

5. Furniture in accordance with claim 1 wherein said mating structure on the tongue is a shoulder at a notch adjacent the innermost end of said tongue.

6. Furniture in accordance with claim 1 wherein said removable cushion is a seat cushion, said frame having a back cushion, the lowermost corners of said back cushion being rectangular with the bottom surface of the back cushion being perpendicular to the sides thereof.

7. Furniture comprising a frame having at least two removable seat cushions which are generally horizontally disposed side-by-side and at least two removable back cushions which are generally vertically disposed side-by-side, each seat cushion abutting one of the back cushions, each cushion having oppositely disposed grooves which are exposed and extend for a length shorter than the length of the cushions, latch means within each cushion, each latch means including a pair of latch members, each latch member projecting into a separate one of the grooves on its associated cushion for latching cooperation with mating rails on the frame, an actuator in each cushion and connected to its associated latch members for releasing the associated latch members so that the cushions may be removed from the frame, said back cushions resting on said seat cushions so that their latch means are obscured by said seat cushions.

8. Furniture in accordance with claim 7 wherein each actuator has a pair of axially extending projections on an end thereof, a plate having a non-circular keyhole attached to each cushion adjacent said end of its associated actuator, said projection being adapted to cooperate with a key to facilitate movement of said latch members.

9. Furniture in accordance with claim 7 wherein the rails for the seat cushions are tilted so that the rear ends of the rails are lower than the front ends.

10. Furniture in accordance with claim 7 wherein each cushion has a frame which pivotably supports its actuator on one wall and reciprocably supports the latch members on parallel walls which are perpendicular to said one wall.

* * * * *